United States Patent [19]

Cantwell et al.

[11] 3,943,953

[45] Mar. 16, 1976

[54] UMBRELLA TENT

[75] Inventors: Robert R. Cantwell, New Haven; Tom E. Marquart, Leslie, both of Mo.

[73] Assignee: Kellwood Company, St. Louis, Mo.

[22] Filed: Aug. 21, 1974

[21] Appl. No.: 499,307

[52] U.S. Cl. ..... 135/3 E; 135/15 PQ; 135/DIG. 9

[51] Int. Cl.[2] ..... A45F 1/04; A45F 1/16

[58] Field of Search ..... 135/3 E, 3 R, 7.1 R, 8, 135/15 PQ, DIG. 9

[56] References Cited

UNITED STATES PATENTS

| | | | |
|---|---|---|---|
| 1,542,184 | 6/1925 | Stoll | 135/3 R |
| 2,167,861 | 8/1939 | Baruch | 135/8 |
| 2,294,835 | 9/1942 | Dazzo | 135/DIG. 9 |
| 2,357,056 | 8/1944 | Nelson | 135/7.1 R |
| 2,889,840 | 6/1959 | McIlwaine | 135/DIG. 9 |
| 3,454,021 | 7/1969 | Morris | 135/3 E |

FOREIGN PATENTS OR APPLICATIONS

| | | | |
|---|---|---|---|
| 726,467 | 1/1966 | Canada | 135/3 E |
| 1,232,455 | 4/1960 | France | 135/3 R |
| 643,507 | 9/1950 | United Kingdom | 135/15 PQ |

*Primary Examiner*—Werner H. Schroeder
*Assistant Examiner*—Conrad L. Berman
*Attorney, Agent, or Firm*—Koenig, Senniger, Powers and Leavitt

[57] ABSTRACT

A tent comprising four walls and a peaked roof, the upper edges of the walls constituting eaves which generally form a rectangle when the tent is erected. The tent further comprises an external frame for holding the tent erect including a pair of eave frame members for attachment to two opposite eaves extending generally parallel to the two eaves on the outside thereof and a pair of poles, one for each of the eave frame members, for supporting the eave frame members to hold the tent erected. Each pole has means at its upper end for connection to the respective eave frame member generally at the center of length of the eave frame member. The external frame also has a ridge frame member extending generally centrally over the roof of the tent from one of the eave frame members to the other. The ridge frame member has means for connection of the center thereof to the peak of the roof.

1 Claim, 5 Drawing Figures

UMBRELLA TENT

BACKGROUND OF THE INVENTION

This invention relates to tents, and more particularly to so-called umbrella tents.

Umbrella tents conventionally have an external frame from which the tent side and top panels are supported. In prior umbrella tents, the frame typically included upright support poles on each side or at the corners of the tent to which the eaves of the tent were secured and a ridge frame extending up over the roof of the tent from the upper ends of the support poles to support the peak of the tent. While umbrella tents are relatively simple to erect as compared to more conventional tents, the number of support poles and ridge membes heretofore required to make the tent stable posed some problems on erection.

SUMMARY OF THE INVENTION

Among the several objects of this invention may be noted the provision of an umbrella tent of this invention having fewer support frame members and utilizing portions of the tent fabric to stabilize the tent when erected; the provision of such a tent having a support frame in which portions may be clipped together; the provision of such a tent which is easily and quickly erected; and the provision of such a tent which is attractive in appearance. Other objects and features of the invention will be in part apparent and in part pointed out thereinafter.

Briefly, a tent of the present invention comprises four walls, a peaked roof and an external frame structure for holding the tent erect. The upper edges of the walls constitute eaves which generally form a rectangle when the tent is erected. The frame structure includes a pair of eave frame members for attachment to two opposite eaves extending generally parallel to those eaves on the outside thereof, and a pair of poles, one for each eave frame member, for supporting the eave frame members to hold the tent erected. Each pole has means at its upper end for connection to the respective eave frame member generally at the center of length of the eave frame member. The frame structure also includes a ridge frame member extending generally centrally over the roof of the tent from one of the eave frame members to the other. The ridge frame member has means for connection of the center thereof to the peak of the roof.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
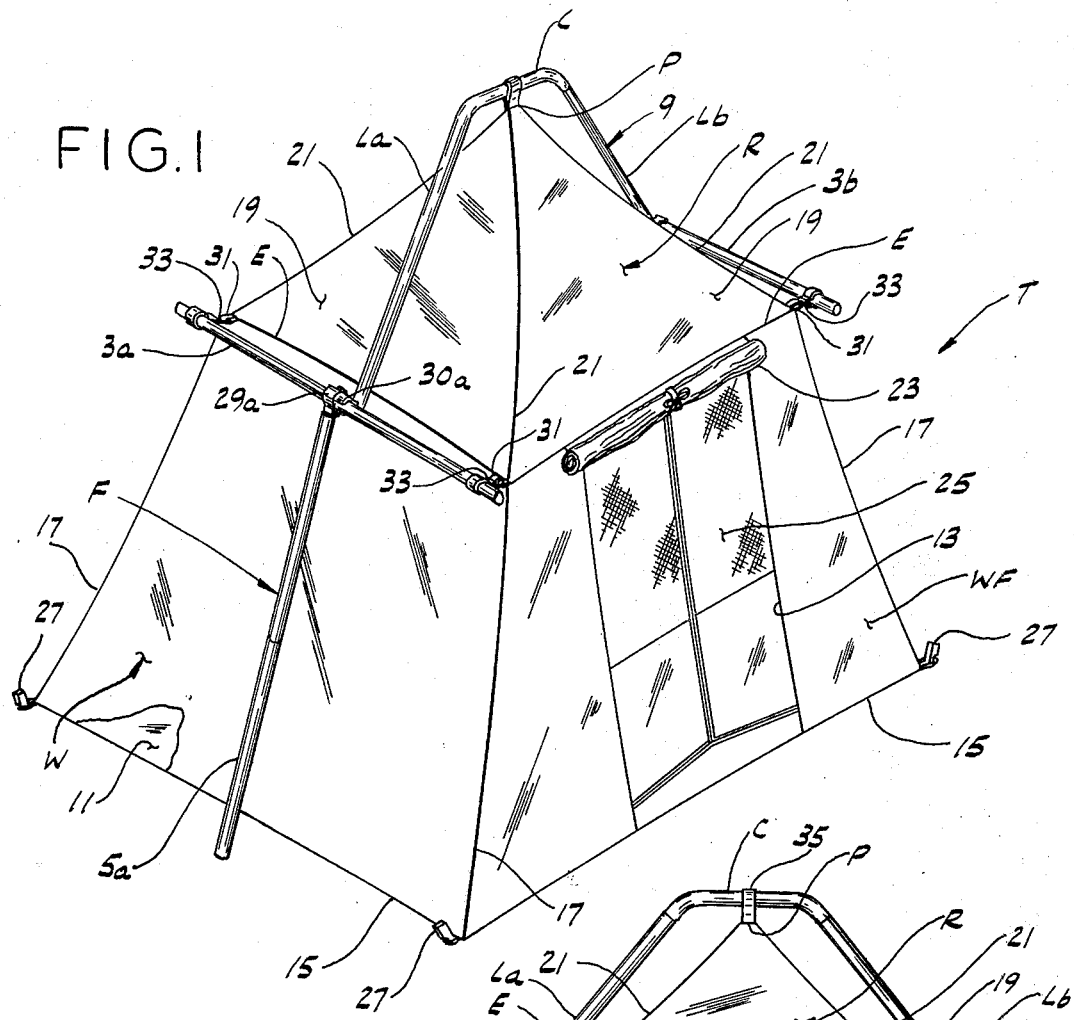
FIG. 1 is a perspective of a tent of the present invention shown in its erected position.
Figure 2:
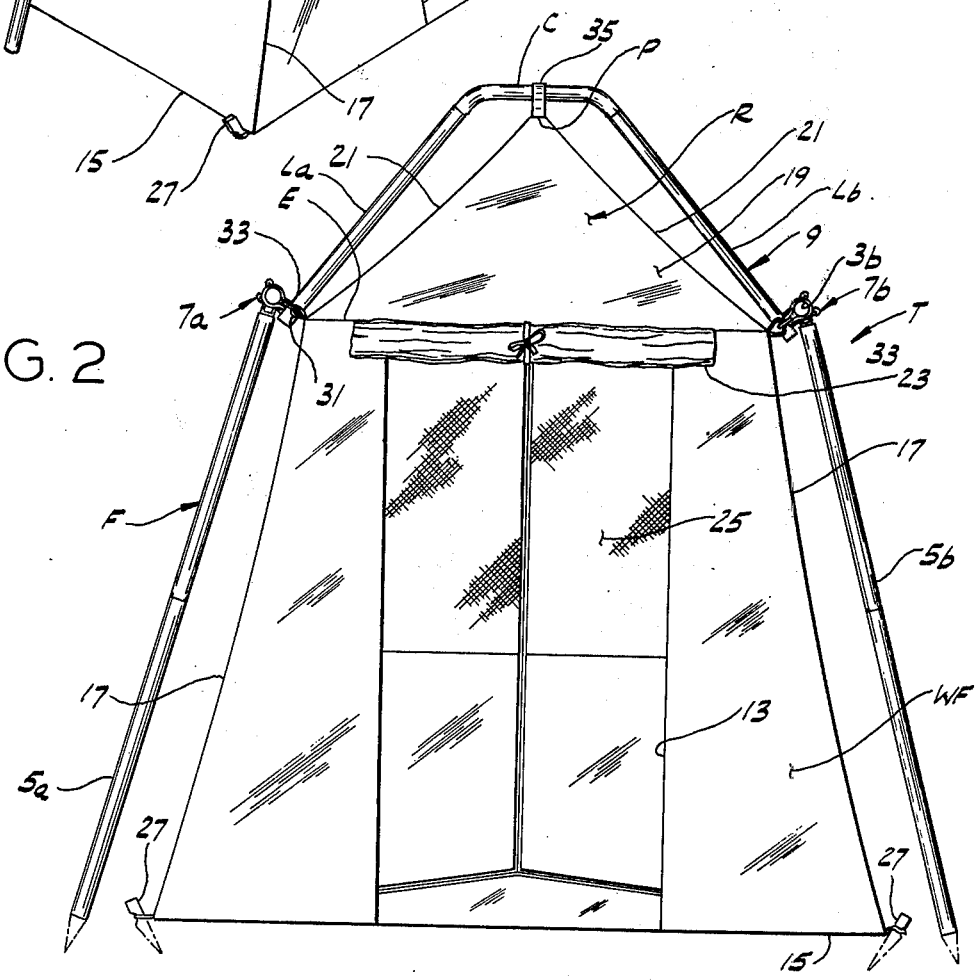
FIG. 2 is a front elevation of the tent with its support frame shown in exaggerated scale to illustrate details of the frame.
Figure 3:
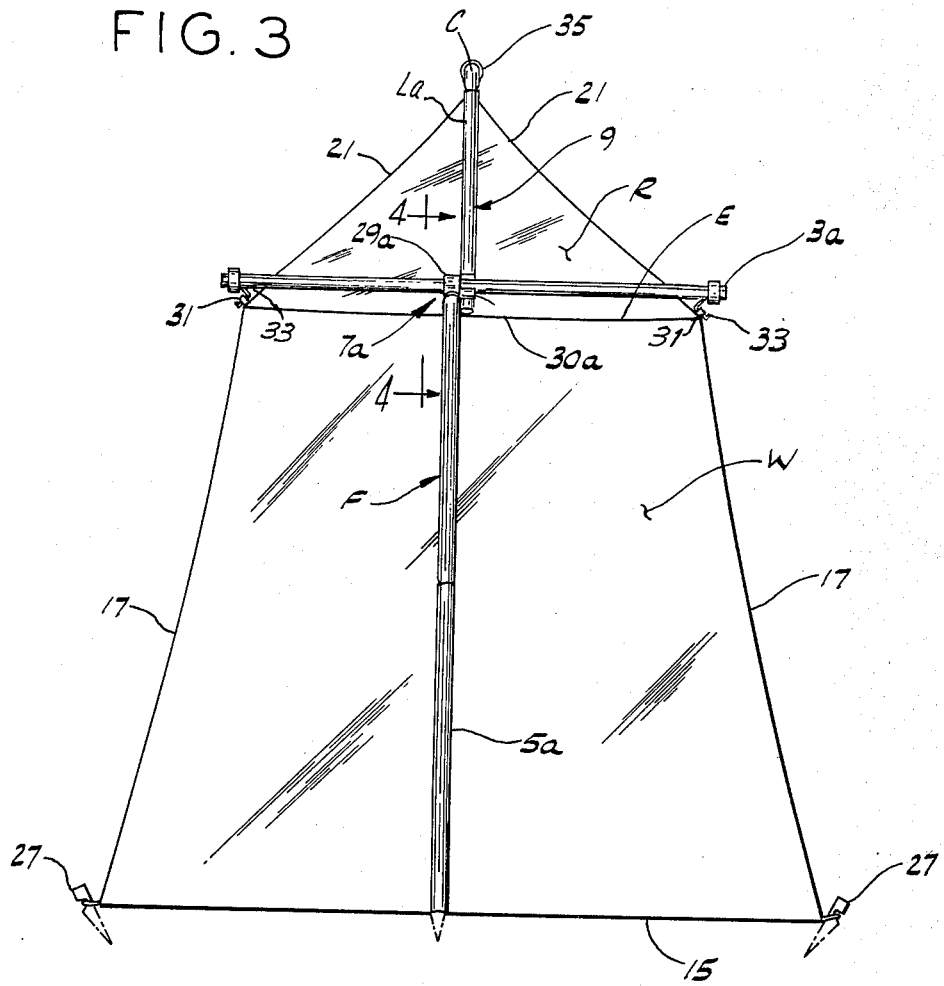
FIG. 3 is a side elevation of the tent.

Referring now to the drawings, an umbrella tent of the present invention is indicated in its entirety at T. This tent has four walls W and a peaked roof R constituting a tent body with the upper edges of the walls constituting eaves E which generally form a rectangle (as viewed from above) when the tent is erected. The tent has an external frame F which holds the tent body erect and which includes only two eave frame members or bars 3*a*, 3*b* adapted for attachment to two opposite eaves E (e.g., the eaves at the sides of the tent). These eave frame members extend generally parallel to their respective eaves on the outside thereof. Frame F further includes only two support poles 5*a*, 5*b* for eave members 3*a*, 3*b*, respectively, for supporting the eave members to hold the tent erect. Each pole 5*a*, 5*b* has means 7*a*, 7*b*, respectively, at its upper end for connection to the respective eave frame member 3*a*, 3*b* at the center of the length of the eave frame member. Only one ridge frame member 9 extends generally centrally over the roof R from one eave frame member to the other with the peak of roof R connected to the center of the ridge frame member.

More particularly the tent body of tent T has a generally square floor panel 11. Walls W are shown to be identical except that the front wall WF has a door 13 therein. These walls are generally in the shape of an isosceles trapezoid having their bases sewn to the outer edges of floor panel 11 as indicated at 15. Adjacent upright sides of walls W and WF are sewn together along seams 17. Thus the floor panel and walls W and WF for a truncated tetrahedron. Roof R is formed by four triangular roof panels 19. The base of each roof panel is sewn to the upper edge of a respective wall W or WF and thus constitutes an eave E. Adjacent sides of the roof panels are sewn together along seams 21 and the points of the roof panels from a roof peak P. Wall WF is shown to have a roll flap 23 for closing door 13 and screens 25 provide ventilation for the tent when curtain 23 is open. It will be understood that walls W may be provided with windows (not shown). The lower corners of tent T are secured to the ground by stakes 27.

Figure 4:
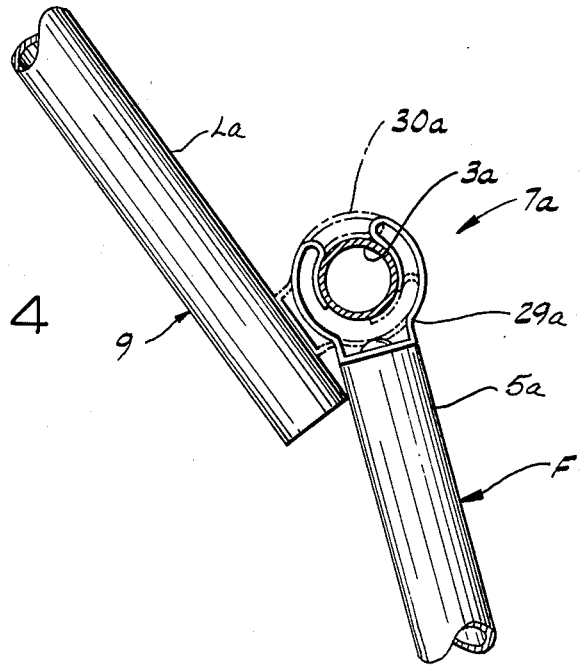
FIG. 4 is an enlarged cross sectional view taken on line 4—4 of FIG. 3 of a portion of the support frame illustrating clips for releasably connecting portions of the frame.
Figure 5:
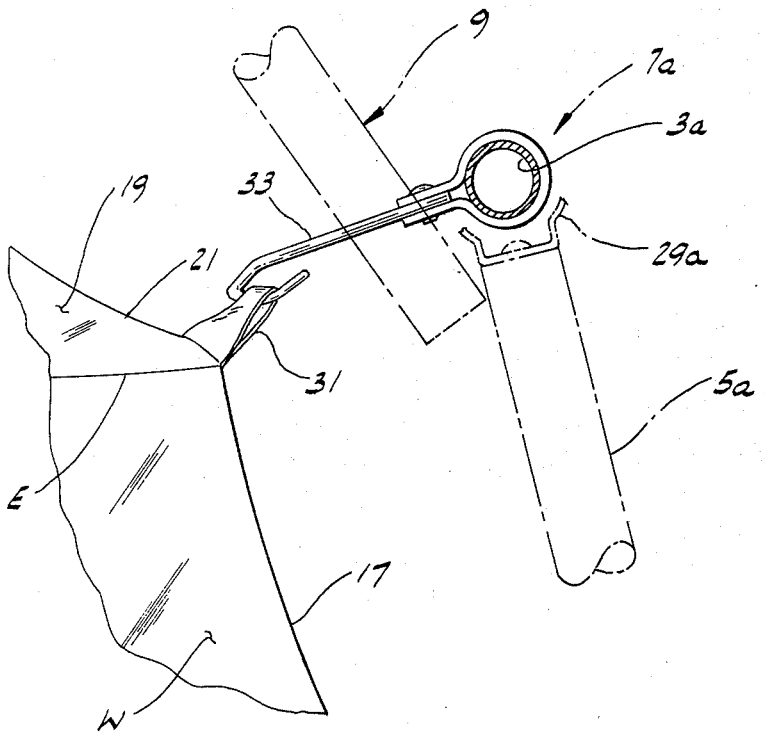
FIG. 5 is an enlarged view of a portion of the support frame illustrating hook and loop attachment means for connection of the eaves of the tent to the ends of the eave frame members with certain of the frame members shown in phantom and with the clips broken away.

Preferably, eave members 3*a*, 3*b*, support poles 5*a*, 5*b* and ridge frame 9 are of aluminum tubing and the support poles and the ridge frame may be made in sections which telescopically interfit with one another when assembled in a manner well known in the art to enable frame F to be compactly stowed. Means 7*a*, 7*b* for detachable connection of the upper end support poles 5*a*, 5*b* to their respective eave frame member 3*a* or 3*b* is shown in FIG. 4 to be generally U-shaped clips 29*a*, 29*b* of resilient metal or the like having an opening somewhat smaller than the diameter of eave member 3*a*, 3*b*. When pushed onto a respective eave frame member, these clips resilinetly grip the eave members and thus hold the poles 5*a*, 5*b* secured to their respective eave frame members. Ridge frame member 9 comprises a generally horizontal center portion C disposed above the peak P and legs L*a*, L*b* angling downwardly toward a respective eave frame member 3*a*, or 3*b*, the legs telescopically interfitting with angled end portions of the center portion. Each leg L*a*, L*b* is provided with a respective clip 30*a* or 30*b* identical to clips 29*a*, 29*b*. Preferably, clips 30*a*, 30*b* are mounted on the outside of their respective legs in the plane of the ridge frame member adjacent the ends of its legs as shown in phantom in FIG. 4 so that the eave members are on the outside of the ridge frame legs. At the intersections of seams 17 and 21 and eaves E, a loop 31 is sewn to the tent body. Each eave member 3*a*, 3*b* has a hook 33 at each outer end for detachable connection with a respective loop 31 for supporting the tent at the corners of its eaves. Roof R has a loop 35 sewn to peak P. The center portion C of ridge frame member 9 is insertable through loop 35 so that with clips 30*a*, 30*b* on the ends of the ridge frame member legs clipped on respective eave members 3*a*, 3*b* and with clips 29*a*, 29*b* on the ends of poles 5*a*, 5*b* clipped on the eave members as shown in FIG. 4, the weight of the tent walls and roof panels is transferred to frame F and the tent is supported in upright position. With the lower corners of the tent staked to the ground by stakes 27, the various walls W and roof panels 19 brace and stabilize frame F and thus act as tension members to stably support the tent in erected position.

To erect a tent T of this invention, the tent is placed on the ground and its floor 11 stretched to its erected position. The corners of the tent are staked to the ground by stakes 27. Ridge frame member 9 is inserted through loop 35 and hooks 33 on the ends of eave frame members 3*a*, 3*b* are hooked into respective loops 31. The roof R is raised to its erected position and clips 29*a*, 29*b* on poles 5*a*, 5*b* and clips 30*a*, 30*b* on ridge frame legs L*a*, L*b* are clipped on respective eave frame members 3*a*, 3*b*. The lower ends of poles 5*a*, 5*b* are implanted in the ground so that the poles incline upwardly at an angle somewhat less than the slope of walls 11.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A tent comprising four walls and a peaked roof, the upper edges of the walls constituting eaves which generally form a rectangle when the tent is erect, the lower edges of the walls being adapted to be secured to the ground, and an external frame structure for holding the tent erect with said walls and roof constituting tension members for bracing and for stabilizing the frame, the latter comprising only two eave frame members disposed adjacent to two opposite eaves and extending generally parallel to said two eaves on the outside thereof, only two poles, one for each of said eave frame members, extending up from the ground on the outside of two opposite of said walls for supporting said eave frame members and for holding the tent and only one ridge frame member extending generally centrally over the roof of the tent from one of said eave frame members to the other for holding said peaked roof erect above said eaves, said eave frame members being connected at their ends to said tent adjacent the corners of said rectangle, said ridge frame member being connected generally at its center to the peak of the roof, each pole having a resilient clip at its upper end for connection to its respective eave frame member generally at the center of length of the eave frame member, and said ridge frame member having a resilient clip at each of its ends for connection to said eave frame members generally at the center of length of the latter.

* * * * *